United States Patent [19]

Wedel

[11] Patent Number: 4,875,976

[45] Date of Patent: Oct. 24, 1989

[54] TRANSFER APPARATUS FROM PRESS SECTION TO DRYING SECTION

[75] Inventor: Gregory L. Wedel, Beloit, Wis.

[73] Assignee: Beloit Corporation, Beoit, Wis.

[21] Appl. No.: 249,798

[22] Filed: Sep. 27, 1988

[51] Int. Cl.[4] ..... D21F 11/00; F26B 13/10

[52] U.S. Cl. ..... 162/306; 34/117; 34/120; 34/116; 162/202; 162/290

[58] Field of Search ..... 162/202, 204, 206, 207, 162/306, 307, 290; 34/114, 116, 117, 120, 156

[56] References Cited

U.S. PATENT DOCUMENTS

| | | | |
|---|---|---|---|
| 3,526,574 | 9/1970 | Beachler et al. | 162/205 |
| 3,874,997 | 4/1975 | Kankaanpaa | 162/116 |
| 4,414,757 | 11/1983 | Whipple | 34/156 |
| 4,551,203 | 11/1985 | Eskelinen | 162/202 |
| 4,698,918 | 10/1987 | Kotitschke et al. | 34/116 |
| 4,698,919 | 10/1987 | Wedel | 162/202 |
| 4,757,619 | 7/1988 | Villalobos | 34/116 |

*Primary Examiner*—Karen Hastings

*Attorney, Agent, or Firm*—Dirk J. Veneman; Raymond W. Campbell; David J. Archer

[57] ABSTRACT

A transfer apparatus is disclosed for transferring a web from a press section to a first dryer of a dryer section. The apparatus includes a lead-in roll which is disposed closely adjacent to the press section. A felt extends around the lead-in roll and from the lead-in roll to the first dryer such that the web extends in an "open draw" from the press section to the lead-in roll and is thereafter supported by and beneath the felt towards a dryer nip defined between the felt and the first dryer. A vacuum generating device is disposed adjacent to the dryer nip such that the web and the felt are disposed between the vacuum generating device and the first dryer. The web is disposed between the felt and the first dryer, and the vacuum generating device induces a partial vacuum in the vicinity of the nip so that wrinkling and breakage of the web as the web approaches the nip is inhibited.

2 Claims, 4 Drawing Sheets

TRANSFER APPARATUS FROM PRESS SECTION TO DRYING SECTION

BACKGROUND OF THE INVENTION

1. FIELD OF THE INVENTION

This invention relates to a transfer apparatus and method for transferring a web from a press section to a first dryer of the dryer section. More particularly, this invention relates to a transfer apparatus which includes a vacuum generating means disposed adjacent to the dryer nip for inhibiting wrinkling and breakage of the web.

2. INFORMATION DISCLOSURE STATEMENT

The transfer of a wet web from the press section to the dryer section of a papermaking machine has become a critical area in the production of light-weight grades of paper at high speeds. The web is usually transferred between the press section and the dryer section in an "open draw". In such "open draw", the sheet remains unsupported for a finite length between the press and dryer sections, and such unsupported lengths are subject to web flutter, breakage, and wrinkling as the web enters the dryer felt nip area.

In the prior art, several methods and arrangements have been proposed in an effort to minimize the aforementioned wrinkling. One method includes increasing the speed differential between the press section and the dryer section. Such difference between the press section and dryer section speeds tends to tighten the web, but it also tends to increase the susceptibility of the web to tension breaks.

In other proposals, the lead-in felt roll is moved in very close to the press roll in an effort to minimize the length of the "open draw". Such minimization of the "open draw" reduces the exposure of the web to external air currents; nevertheless, the web still tends to separate from the felt and cause wrinkling of the web as the web attempts to enter the nip between the dryer felt and the dryer surface.

Such separation of the web from the supporting felt has been the subject of several patent applications directed towards means for urging the web into contact with the felt.

U.S. Pat. No. 3,526,574 to Amend teaches a vacuum transfer box. Also, U.S. Pat. No. 4,551,203 to Eskelinen describes a blowing type vacuum box. Additionally, U.S. Pat. No. 4,698,919 to Wedel discloses an eductor type transfer box.

The problem with each of the aforementioned boxes is that the vacuum induced by these boxes must be high enough to evacuate all of the air between the web and the felt before the felt nip. Such high vacuum tends to pull the felt into contact with the boxes and this physical contact between the felt and the boxes tends to wear out the felt and the box seals, and can cause the web to locally separate from the felt.

The problem with the prior art devices stems from a failure to recognize the primary cause of the separation of the web from the felt. More particularly, the prior art devices have assumed that the separation is caused primarily by centrifugal forces and by gravity. However, the real cause is a "nip rejection" phenomenon. More specifically, the slight amount of air which naturally remains in-between the felt and the web is expelled in a counterdirection at the dryer felt nip. Such rejected air accumulates between the felt and the web and causes the web to separate by a significant amount from the felt. This separation can be observed to originate at the dryer felt nip and move progressively upstream towards the lead-in felt roll. The aforementioned separation can be prevented by applying a high level vacuum above the felt, just prior to the nip area, to evacuate the rejected air. Such high level of vacuum, which can compensate for the "nip rejection" phenomenon, cannot be readily applied along the full length of the felt as it would cause excessive wearing contact between the felt and the vacuum inducing boxes. Instead, the apparatus, according to the present invention, applies the high level vacuum only to the area immediately adjacent to the dryer felt nip.

Such vacuum is produced by means which is located in operative proximity to the area of the dryer felt converging nip, but on the opposite side of the felt from the web.

Therefore, it is a primary objective of the present invention to provide a transfer apparatus and method that overcomes the aforementioned inadequacies of the prior art proposals, and which makes a considerable contribution to the art of transferring a web from a press to a dryer section.

SUMMARY OF THE INVENTION

The present invention relates to a transfer apparatus and method for transferring a web from a press section to a first dryer of a dryer section. The apparatus includes a lead-in roll which is disposed closely adjacent to the press section. A felt extends around the lead-in roll and from the lead-in roll to the first dryer, such that the web extends in an "open draw" from the press section to the lead-in roll. The web is thereafter supported by and beneath the felt towards a dryer nip defined between the felt and the first dryer. A vacuum generating means is disposed adjacent to the dryer nip such that the web and the felt are disposed between the vacuum generating means and the first dryer. The web is disposed between the felt and the first dryer and the vacuum generating means induces a partial vacuum in the vicinity of the nip between the felt and the web so that wrinkling and breakage of the web as the web approaches the nip is inhibited.

More particularly, in a specific embodiment of the present invention, the vacuum generating means is a blow box which defines a slot extending in a cross-machine direction across the width of the felt such that air flows from within the blow box through the slot in a direction substantially parallel to and opposite to the direction of movement of the felt for inducing the partial vacuum between the felt and the web.

More specifically, the slot has a first and a second lip. The first lip has a curved configuration such that air within the blow box flows in a direction initially radially towards the first dryer and then curves in a direction to follow the first lip due to the Coanda effect, and thereafter follows a direction substantially parallel to and opposite to the direction of movement of the felt so that a partial vacuum is generated between the blow box and the felt which in turn induces the partial vacuum between the felt and the web.

The aforementioned flow of air in a direction parallel to and opposite to the direction of movement of the felt deflects boundary air that follows the felt from the lead-in roll towards the blow box, thereby augmenting the partial vacuum induced between the felt and the web in the vicinity of the nip.

In a preferred embodiment of the present invention, the partial vacuum is induced from the nip to a distance upstream relative to the nip within the range 4–10 inches from the nip.

In an alternative embodiment of the present invention, the vacuum generating means is a vacuum box, the vacuum box being connected to a source of partial vacuum. The vacuum box defines an opening which is disposed closely adjacent to the nip, with the opening extending in a cross-machine direction across the width of the felt.

More particularly, the vacuum box includes a felt wall which defines the opening, the felt wall being disposed substantially parallel to the felt. The vacuum box also includes an upstream wall joined in a cross-machine direction to the felt wall, with the upstream wall and the felt wall defining therebetween an acute angle. The arrangement is such that boundary air following the felt from the lead-in roll towards the vacuum box is directed away from the felt, thereby augmenting the partial vacuum induced between the felt and the web in the vicinity of the nip.

In a further embodiment of the present invention, the vacuum generating means is a foil box.

More specifically, the foil box includes a diverging wall which diverges from a point closely adjacent to the felt and upstream relative to the nip to a further point is disposed downstream relative to the nip. The diverging wall generates a partial vacuum between the diverging wall and the felt which induces the partial vacuum between the felt and the web in the vicinity of the nip.

Furthermore, the foil box further includes an upstream wall joined in a cross-machine direction to the diverging wall. The upstream wall and the diverging wall define therebetween an acute angle such that boundary air following the felt from the lead-in roll towards the foil box is diverted away from the felt, thereby augmenting the partial vacuum induced between the felt and the web.

In another embodiment, the transfer apparatus includes a diverging shield which is disposed between the lead-in roll and a blow box, such that the felt is disposed between the diverging shield and the web. The diverging shield diverges from a first location disposed closely adjacent to the lead-in roll to a second location disposed closely adjacent to the blow box so that boundary air following the felt is diverted by the diverging shield away from the felt and around the blow box.

A method of transferring a web from a press section to a first dryer of a dryer section, said method comprising the steps of:

guiding the web in an open draw from the press section to a lead-in roll disposed closely adjacent to the press section;

supporting the web by and beneath a felt which extends around the lead-in roll and from the lead-in roll to the first dryer such that the web extends from the lead-in roll towards a dryer nip defined between the felt and the first dryer; and inducing a partial vacuum in the vicinity of the nip, the partial vacuum being induced between the felt and the web so that wrinkling and breakage of the web as the web approaches the nip is inhibited.

Many modifications and variations of the present invention will be readily apparent to those skilled in the art by a consideration of the detailed description taken in conjunction with the annexed drawings. Such variations and modification, however, fall within the spirit and scope of the present invention, as defined by the appended claims.

BRIEF DESCRIPTION OF THE DRAWINGS

Similar reference characters refer to similar parts throughout the various embodiments of the present invention.

DETAILED DESCRIPTION OF THE DRAWINGS

Figure 1:
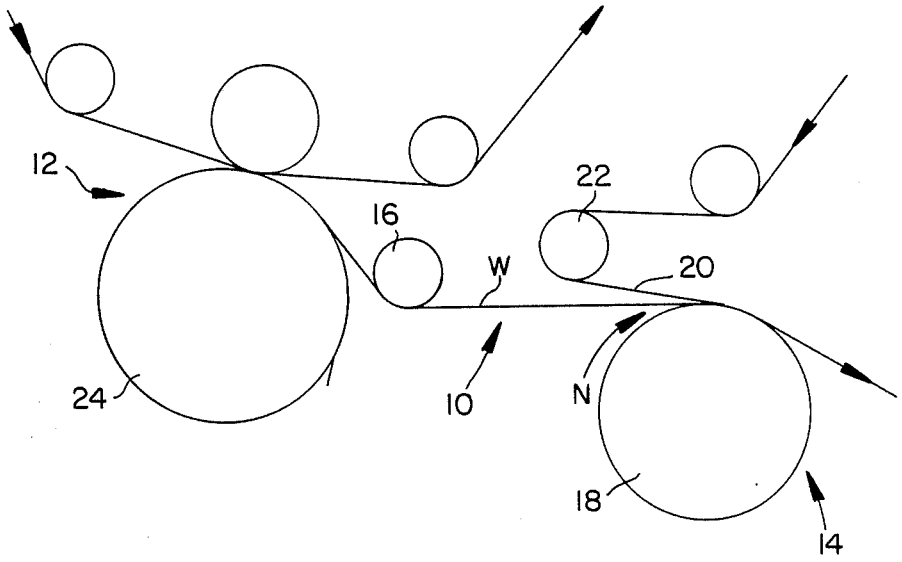
FIG. 1 PRIOR ART
FIG. 1 is an elevational view of a typical prior art web transfer apparatus showing the web unsupported between the press section and the dryer section.

FIG. 1 is an elevational view of the typical prior art transfer apparatus generally designated 10 for transferring a web W from a press section generally designated 12 to a dryer section generally designated 14. The web W is guided around a guide roll 16 towards a nip N defined between a first dryer 18 and a cooperating dryer felt 20. A lead-in felt roll 22 is disposed upstream relative to the nip N but the dryer felt 20 does not support the web W between the press section 12 and the dryer section 14. Therefore, the web W is unsupported between a press roll 24 of the press section 12 and the first dryer 18. Such prior art arrangements permit sheet flutter and wrinkling between the press roll 24 and the first dryer 18.

Figure 2:
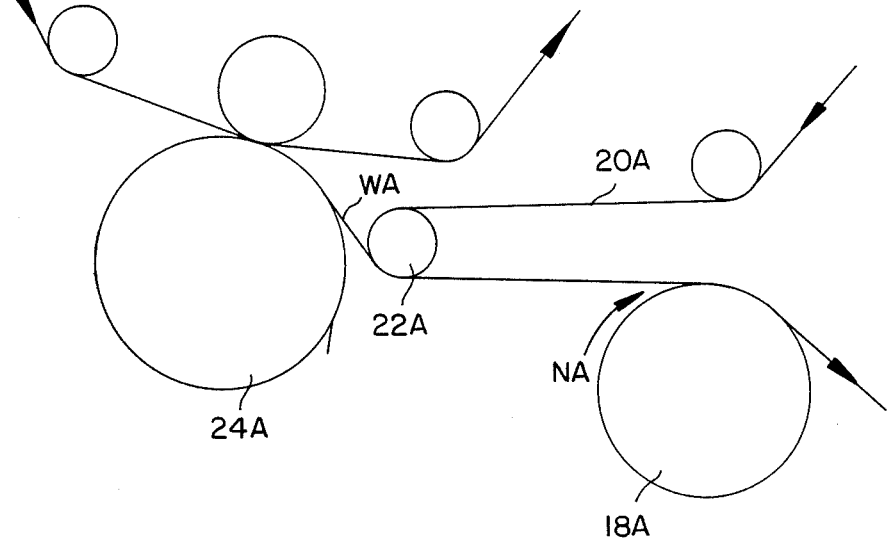
FIG. 2 PRIOR ART
FIG. 2 is an elevational view of a prior art transfer apparatus having a lead-in felt roll for reducing the "open draw"

FIG. 2 is an elevational view of another prior art arrangement in which a lead-in felt roll 22A guides a dryer felt 20A towards a first dryer 18A. The lead-in roll 22A is disposed closely adjacent to a press roll 24A and the web WA is guided from the press roll 24A to and around the lead-in roll 22A, such that the web WA is supported by the dryer felt 20A between the lead-in roll 22A and the first dryer 18A.

Although the arrangement shown in FIG. 2 reduces the "open draw" of the web to the span from press roll 24A to lead-in roll 22A, there still exists a tendency for the web WA to wrinkle relative to the dryer felt 20A as the web WA approaches the nip NA. Such tendency to wrinkle is caused by the "nip rejection" phenomenon created by residual air disposed between the web WA and the dryer felt 20A in the vicinity of the nip NA. Such residual air tends to move in a direction opposite to the direction of movement of the felt and web towards the nip NA, thereby causing the aforementioned wrinkling and occasional breakage of the web.

Figure 3:
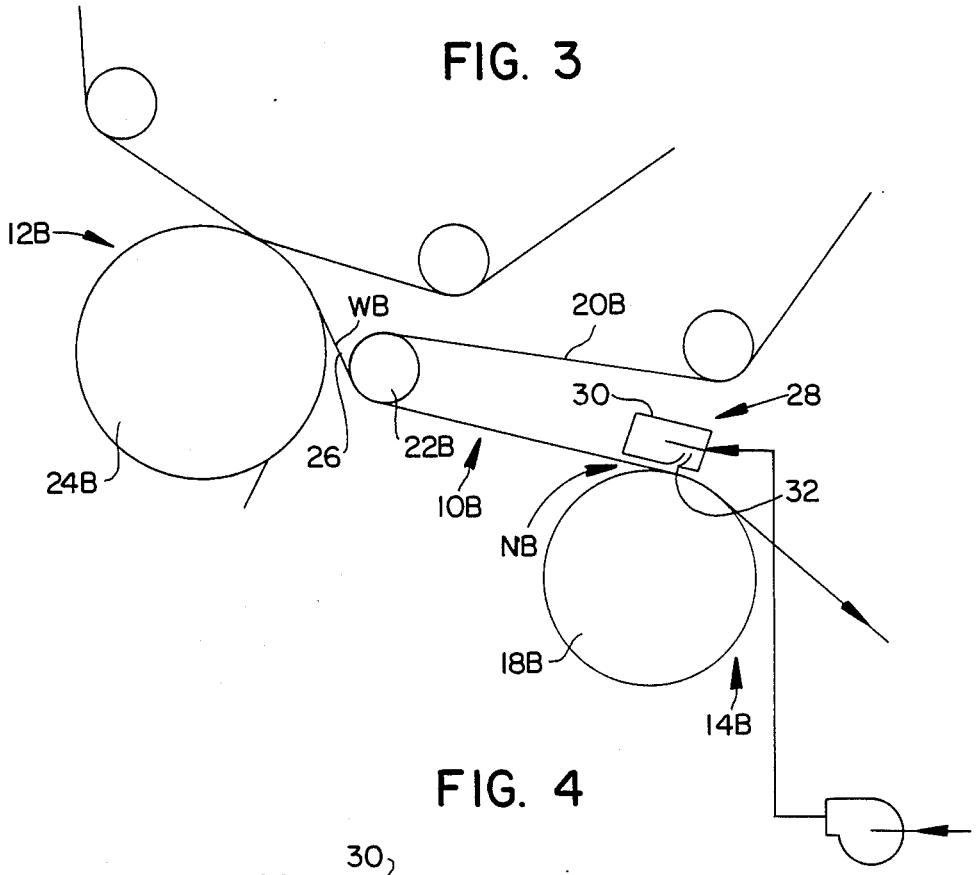
FIG. 3 is an elevational view of the transfer apparatus according to the present invention showing a blow box in the vicinity of the felt dryer nip.

The aforementioned problem of web wrinkling in the vicinity of the nip is overcome by the various exemplary embodiments of the present invention in which FIG. 3 is an elevational view of a transfer apparatus generally designated 10B for transferring a web WB from a press section 12B to a first dryer 18B of a dryer section 14B.

The apparatus 10B includes a lead-in roll 22B which is disposed closely adjacent to the press section 12B. A felt 20B extends around the lead-in roll 22B and from the lead-in roll 22B to the first dryer 18B such that the web WB extends in an open draw 26 from the press section 12B to the lead-in roll 22B. The web WB thereafter is supported by and beneath the felt 20B towards a dryer nip NB defined between the felt 20B and the first dryer 18B.

A vacuum generating means generally designated 28 is disposed adjacent to the dryer nip NB such that the web WB and the felt 20B are disposed between the means 28 and the first dryer 18B. The web WB is disposed between the felt 20B and the first dryer 18B. The means 28 induces a partial vacuum in the vicinity of the nip NB between the felt 20B and the web WB so that wrinkling and breakage of the web WB as the web approaches the nip NB is inhibited.

Figure 4:
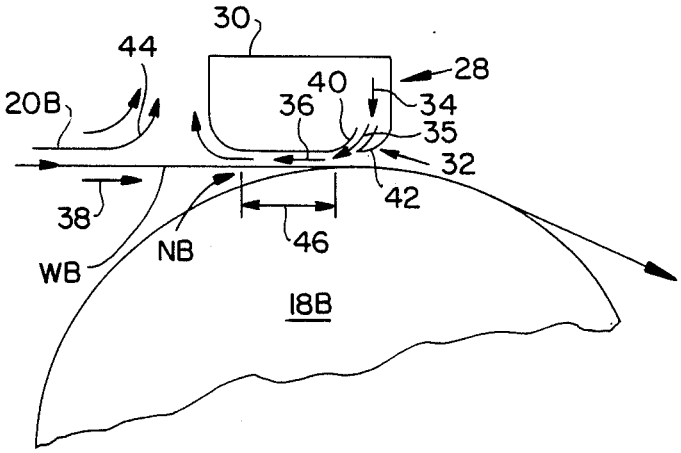
FIG. 4 is an enlarged view of the blow box shown in FIG. 3.

FIG. 4 is an enlarged view of the vacuum generating means 28. More specifically, the vacuum generating means 28 is a blow box 30. The Blow box 30 defines a slot 32 which extends in a cross-machine direction across the width of the felt 20B such that air indicated by the arrow 34 flows from within the blow box 30 towards the slot 32 and then in a direction as indicated by the arrow 36 substantially parallel to and opposite to the direction of movement of the felt 20B (as indicated by the arrow 38) for inducing the partial vacuum between the felt 20B and the web WB.

The slot 32 has a first and a second lip 40 and 42 respectively. The first lip 40 has a curved configuration such that air within the blow box 30 flows in a direction as indicated by the arrow 34 initially radially towards the first dryer 18B, and then curves in a direction as indicated by the arrow 35 to follow the first lip 40 due to the Coanda effect and thereafter follows a direction as indicated by the arrow 36 substantially parallel to and opposite to the direction 38 of movement of the felt 20B so that a partial vacuum is generated between the blow box 30 and the felt 20B which in turn induces the partial vacuum between the felt 20B and the web WB.

The flow of air 36 in a direction parallel to and opposite to the direction of movement 38 of the felt 20B deflects boundary layer air, as indicated by the arrow 44, that follows the felt 20B from the lead-in roll 22B towards the blow box 30, thereby augmenting the partial vacuum induced between the felt 20B and the web WB in the vicinity of the nip NB.

The partial vacuum is induced from the nip NB to a distance 46 upstream relative to the nip NB. Such distance 46 is preferably within the range 4–10 inches.

Figure 5:
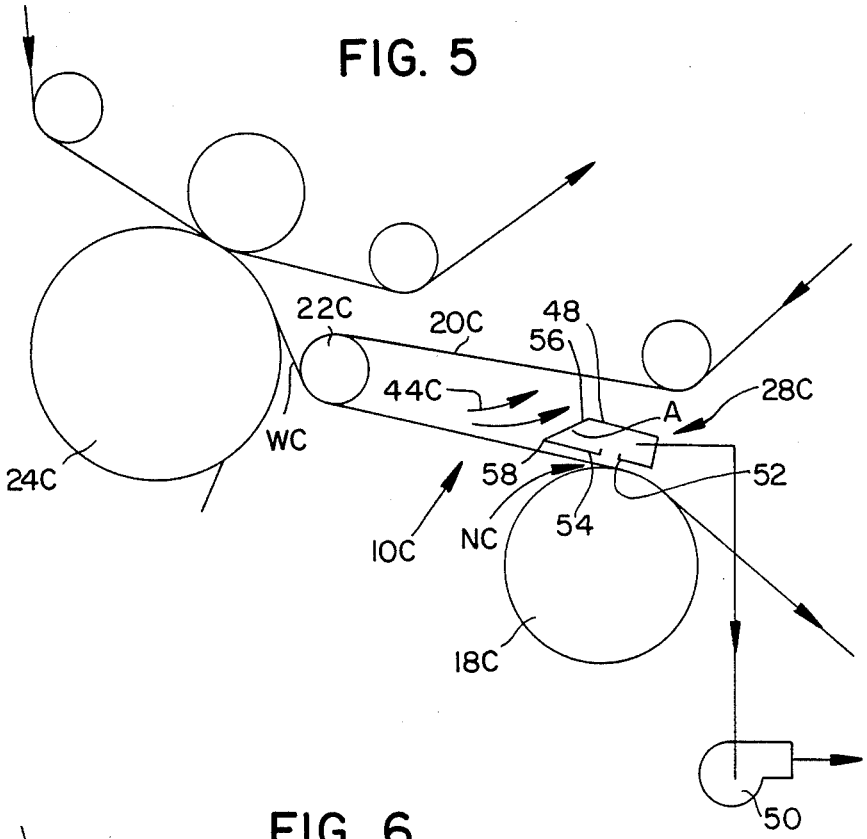
FIG. 5 is an elevational view of the transfer apparatus of the present invention showing an alternative embodiment having a vacuum box.

FIG. 5 is an elevational view of a transfer apparatus generally designated 10C according to a further embodiment of the present invention. The transfer apparatus 10C includes a vacuum generating means generally designated 28C which is a vacuum box 48.

The vacuum box 48 is connected to a source of partial vacuum such as an air blower 50. The vacuum box 48 defines an opening 52 which is disposed closely adjacent to a nip NC defined between a first dryer 18C and a felt 20C. The opening 52 extends in a cross-machine direction across the width of the felt 20C.

More particularly, the vacuum box 48 includes a felt wall 54 which defines the opening 52. The felt wall 54 is disposed substantially parallel to the felt 20C. The vacuum box 48 also includes an upstream wall 56 which is joined in a cross-machine direction at 58 to the felt wall 54. The upstream wall 56 and the felt wall 54 define therebetween an acute angle A such that boundary air 44C following the felt 20C from a lead-in roll 22C towards the vacuum box 48 is deflected away from the felt 20C thereby augmenting the partial vacuum induced between the felt 20C and the web WC in the vicinity of the nip NC.

Figure 6:
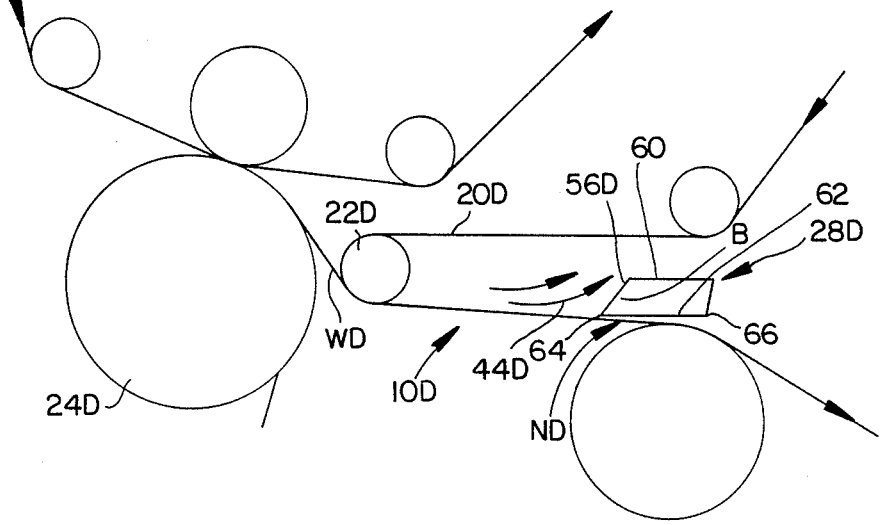
FIG. 6 is an elevational view of a further embodiment of the present invention showing a foil box.

FIG. 6 is an elevational view of a transfer apparatus generally designated 10D according to a further embodiment of the present invention. The transfer apparatus 10D includes a vacuum generating means generally designated 28D which is a foil box 60.

More particularly, the foil box 60 includes a diverging wall 62 which diverges from a point 64 closely adjacent to the felt 20D. The point 64 is upstream relative to a nip ND defined between the felt 20D and a first dryer 18D. The wall 62 diverges relative to the felt 20D from the point 64 to a further point 66 disposed downstream relative to the nip ND for generating a partial vacuum between the diverging wall 62 and the felt 20D which induces the partial vacuum between the felt 20D and the web WD in the vicinity of the nip ND.

The foil box 60 also includes an upstream wall 56D joined in a cross-machine direction to the diverging wall 62. The upstream wall 56D and the diverging wall 62 define therebetween an acute angle B such that boundary air indicated by the arrow 44D following the felt 20D from a lead-in roll 22D towards the foil box 60 is diverted away from the felt 20D thereby augmenting the partial vacuum induced between the felt 20D and the web WD.

Figure 7:
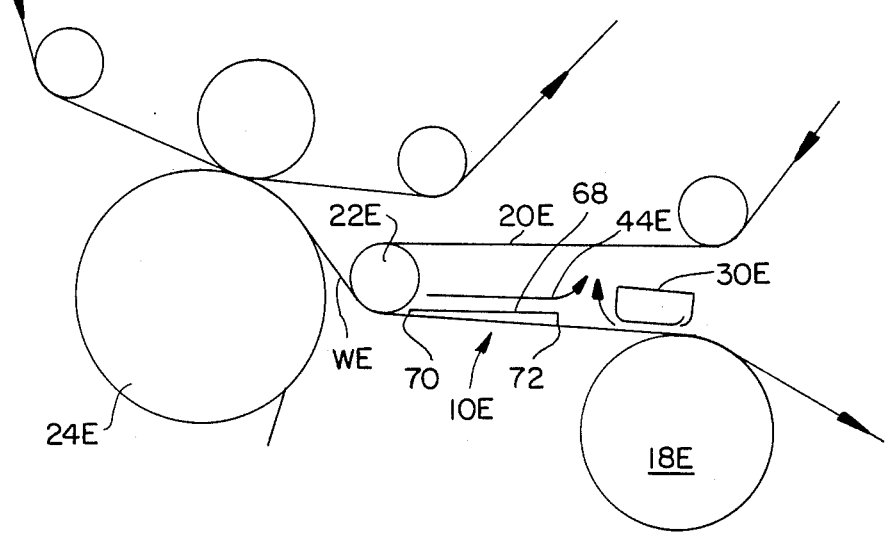
FIG. 7 is an elevational view of another embodiment of the present invention showing a blow box and a shielding device.

FIG. 7 is an elevational view of a transfer apparatus generally designated 10E according to another embodiment of the present invention. The apparatus 10E includes a diverging shield 68 which is disposed between a lead-in roll 22E and a blow box 30E such that a felt 20E is disposed between the diverging shield 68 and the web WE. The diverging shield 68 diverges from a first location 70 which is disposed closely adjacent to the lead-in roll 22E to a second location 72 which is disclosed closely adjacent to the blow box 30E so the boundary air as indicated by the arrow 44E following the felt 20E is diverted by the diverging shield 68 away from the felt 20E and around the blow box 30E.

The present invention provides a simple and inexpensive means for inhibiting the wrinkling of a web supported by a dryer felt as the web approaches the converging nip defined between the dryer felt and the first dryer.

What is claimed is:

1. A transfer apparatus for transferring a web from a press section to a first dryer of a dryer section, said apparatus comprising:

a lead-in roll disposed closely adjacent to the press section;

a felt having a direction of movement and extending around said lead-in roll and from said lead-in roll to the first dryer such that the web extends in an open draw from the press section to said lead-in roll and is thereafter supported by and beneath said felt towards a dryer nip defined between said felt and the first dryer;

vacuum generating means disposed adjacent to said dryer nip such that the web and said felt are disposed between said means and the first dryer, the web being disposed between said felt and the first dryer, said means inducing a partial vacuum adjacent to said nip between said felt and the web so that wrinkling and breakage of the web as the web approaches said nip is inhibited;

said vacuum generating means being a blow box which defines a slot that extends in a cross-machine direction across the width of said felt structured so that air flows from within said blow box through said slot in a direction substantially parallel to and opposite to the direction of movement of said felt for inducing said partial vacuum between said felt and the web;

said partial vacuum being induced from said nip to a distance upstream relative to said nip within the range 4 to 10 inches;

said slot having a first and a second lip, said first lip having a curved configuration such that air within said blow box flows in a direction initially radially towards the first dryer and then curves in a direction to follow said first lip due to the Coanda effect and thereafter follows a direction substantially parallel to and opposite to the direction of movement of said felt so that a partial vacuum is generated between said blow box and said felt which in turn induces said partial vacuum between said felt and the web; and said flow of air in a direction parallel and opposite to the direction of movement of said felt deflecting boundary layer air that follows said felt from said lead-in roll towards said blow box thereby augmenting said partial vacuum induced between said felt and the web in the vicinity of said nip.

2. A transfer apparatus as set forth in claim 1 further including:

a diverging shield disposed between said lead-in roll and said blow box such that said felt is disposed between said diverging shield and the web, said diverging shield diverging relative to said felt from a first location disposed closely adjacent to said lead-in roll to a second location disposed closely adjacent to said blow box so that boundary air following said felt is diverted by said diverging shield away from said felt and around said blow box.

* * * * *